US011164407B2

(12) United States Patent
Tikkanen et al.

(10) Patent No.: US 11,164,407 B2
(45) Date of Patent: Nov. 2, 2021

(54) NEAR FIELD COMMUNICATION TAG

(71) Applicant: iLOQ OY, Oulu (FI)

(72) Inventors: Väinö Tikkanen, Kontio (FI); Janne Heusala, Kempele (FI); Mika Pukari, Oulu (FI)

(73) Assignee: ILOQ OY, Oulu (FI)

( * ) Notice: Subject to any disclaimer, the term of this patent is extended or adjusted under 35 U.S.C. 154(b) by 649 days.

(21) Appl. No.: 16/077,818

(22) PCT Filed: Mar. 9, 2017

(86) PCT No.: PCT/EP2017/055530
§ 371 (c)(1),
(2) Date: Aug. 14, 2018

(87) PCT Pub. No.: WO2017/153514
PCT Pub. Date: Sep. 14, 2017

(65) Prior Publication Data

US 2021/0192876 A1 Jun. 24, 2021

(30) Foreign Application Priority Data

Mar. 10, 2016 (EP) ..... 16159616

(51) Int. Cl.
*G07C 9/00* (2020.01)

(52) U.S. Cl.
CPC ..... *G07C 9/00309* (2013.01); *G07C 9/00817* (2013.01); *G07C 2009/0038* (2013.01);
(Continued)

(58) Field of Classification Search
CPC ..... G07C 9/00
See application file for complete search history.

(56) References Cited

U.S. PATENT DOCUMENTS 5,679,984 A 10/1997 Talbot et al.
7,375,616 B2 5/2008 Rowse et al.
(Continued)

FOREIGN PATENT DOCUMENTS

CN 101162530 4/2008
CN 102007705 4/2011
(Continued)

OTHER PUBLICATIONS

Notification of the Reasons for Rejection dated Jan. 17, 2020 in corresponding Korean Application No. 10-2018-7026213, 13 pages (with English-language translation).
(Continued)

*Primary Examiner* — K. Wong
(74) *Attorney, Agent, or Firm* — Nixon & Vanderhye PC

(57) ABSTRACT

A method and a tag for opening a powerless electromechanical lock are provided. The tag comprises a power source, a near field communication transceiver, an antenna connected to the transceiver, an proximity switch and a controller. The switch is configured to wake up the controller from a low power mode upon a detection of a predetermined signal. The controller is configured after the wake up to activate the near field communication transceiver and control the transceiver to transmit via the antenna wirelessly first operating power to the lock for communication and authentication, perform authentication with the lock and, provided that the authentication is successful, control the transceiver to transmit wirelessly second operating power to the lock for the lock to be set into an openable state.

18 Claims, 3 Drawing Sheets

(52) U.S. Cl.
CPC ..... *G07C 2009/00325* (2013.01); *G07C 2009/00634* (2013.01); *G07C 2009/00769* (2013.01)

(56) References Cited

U.S. PATENT DOCUMENTS

| | | | | |
|---|---|---|---|---|
| 9,406,178 | B2 * | 8/2016 | Pukari | G07C 9/00174 |
| 9,430,888 | B2 * | 8/2016 | Herrala | G07C 9/28 |
| 9,500,006 | B2 * | 11/2016 | Dayanikli | E05B 47/0603 |
| 9,806,689 | B2 * | 10/2017 | Polak | H03F 3/45071 |
| 2008/0092230 | A1 | 4/2008 | Addy | |
| 2010/0073129 | A1 | 3/2010 | Pukari | |
| 2012/0270496 | A1 * | 10/2012 | Kuenzi | G07C 9/00309 455/41.1 |
| 2015/0077232 | A1 | 3/2015 | Grant et al. | |
| 2015/0332527 | A1 | 11/2015 | Pukari | |
| 2017/0116802 | A1 * | 4/2017 | Handville | G07C 9/00658 |

FOREIGN PATENT DOCUMENTS

| | | |
|---|---|---|
| CN | 102970063 | 3/2013 |
| CN | 103328278 | 9/2013 |
| CN | 103366140 | 10/2013 |
| CN | 204440426 U | 7/2015 |
| CN | 204631978 | 9/2015 |
| EP | 1 564 689 | 8/2005 |
| EP | 1 912 180 | 4/2008 |
| JP | 2005-314962 | 11/2005 |
| JP | 2008-510403 | 4/2008 |
| JP | 2009-217824 | 9/2009 |
| JP | 2014-535018 | 12/2014 |
| JP | 2015-094123 | 5/2015 |
| JP | 2015-224463 | 12/2015 |
| KR | 10-2014-0119688 | 10/2014 |

OTHER PUBLICATIONS

Office Action dated Mar. 16, 2020 in corresponding Chinese Application No. 201780006409.6 (with English-language translation), 32 pages.
Decision to Grant dated Jul. 30, 2020 in corresponding Korean Application No. 10-2018-7026213, 2 pages.
International Search Report for PCT/EP2017/055530 dated Jun. 6, 2017, 4 pages.
Written Opinion of the ISA for PCT/EP2017/055530 dated Jun. 6, 2017, 5 pages.
International Preliminary Report on Patentability for PCT/EP2017/055530 dated Mar. 21, 2018, 5 pages.
Search Report for EP16159616.8 dated Aug. 19, 2016, 6 pages.
Office Action dated Jul. 30, 2019 in corresponding Japanese Application No. 2018-547262, 3 pages.

* cited by examiner

NEAR FIELD COMMUNICATION TAG

This application is the U.S. national phase of International Application No. PCT/EP2017/055530 filed Mar. 9, 2017 which designated the U.S. and claims priority to EP Patent Application No. 16159616.8 filed Mar. 10, 2016, the entire contents of each of which are hereby incorporated by reference.

TECHNICAL FIELD

The exemplary and non-limiting embodiments of the invention relate generally to near field communication. Embodiments of the invention relate especially to tags utilising near field communication.

BACKGROUND

The following description of background art may include insights, discoveries, understandings or disclosures, or associations together with disclosures not known to the relevant art prior to the present invention but provided by the invention. Some of such contributions of the invention may be specifically pointed out below, whereas other such contributions of the invention will be apparent from their context.

Various types of electromechanical locking systems are replacing traditional mechanical locking systems and wired access control systems. Electromechanical locking systems provide many benefits over traditional mechanical locking systems. They provide better security and flexible access management of keys, security tokens and locks. Electromechanical locks may utilise digital keys not needing a key way. There is no need for a galvanic contact and thus no there are wearable parts, for example. A wireless electromechanical locking system provides an easy-install and cost effective solution compared to a wired access control system.

In addition, most electromechanical locks and/or keys and tags are programmable. It is possible to program the lock to accept different keys and decline others.

Typical electromechanical locks require an external supply of electric power, a battery inside the lock, a battery inside the key, or means for generating electric power within the lock making the lock user-powered. In addition, there are systems where a mobile phone acts as a key or tag.

BRIEF DESCRIPTION

According to an aspect of the present invention, there is provided a tag as claimed in claim 1.

According to an aspect of the present invention, there is provided a method as claimed in claim 10.

Some embodiments of the invention are disclosed in the dependent claims.

BRIEF DESCRIPTION OF THE DRAWINGS

In the following the invention will be described in greater detail by means of preferred embodiments with reference to the accompanying drawings, in which.

DETAILED DESCRIPTION OF SOME EMBODIMENTS

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments.

Figure 1:
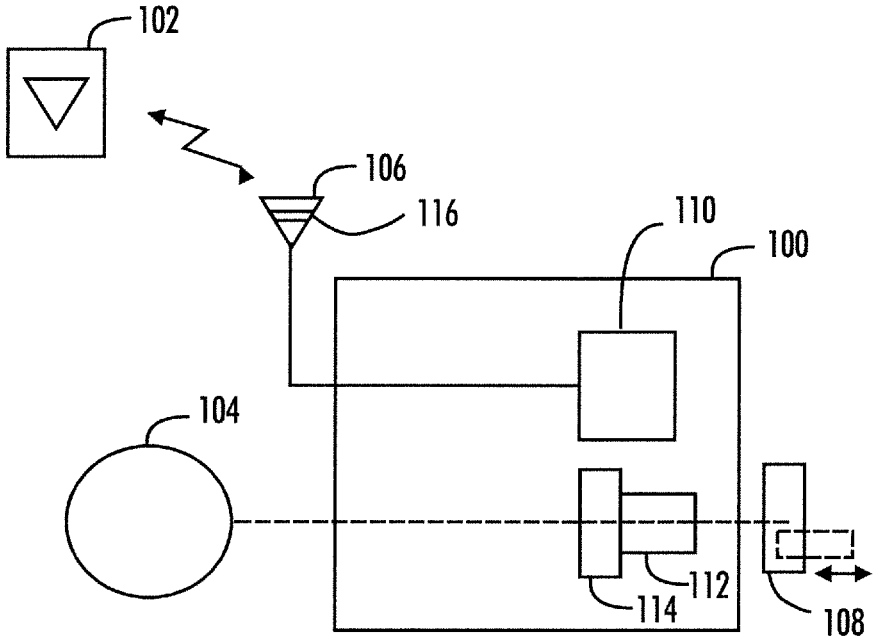
FIG. 1 illustrates an example of an electronic authentication system.

In an embodiment, a tag is utilized for wirelessly opening an electromechanical lock without batteries or wired connection to an external power supply. FIG. 1 shows an embodiment of an electronic locking system. A user (not shown) is about to open a door comprising a lock 100. The user has a tag 102 which is used to open the lock.

Figure 2:
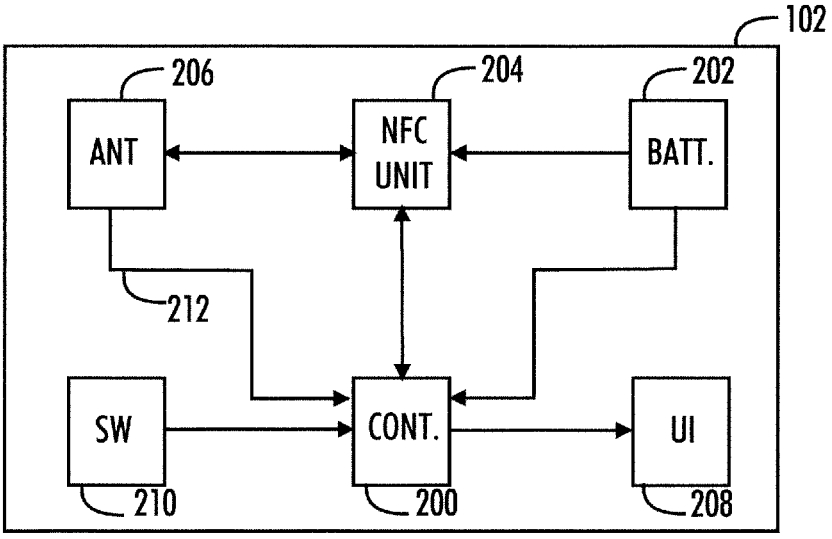
FIG. 2 illustrates an example of an electronic circuitry of a tag.

A conventional passive tag cannot be used for opening a lock without batteries or wired connection to an external power supply. A mobile phone with internal battery must have been used. However, the use of mobile phone is in some instances inconvenient. FIG. 2 illustrates an example of an electronic circuitry of a tag. In an embodiment, the tag is an active device, comprising a power source 202 which may be a replaceable battery or a rechargeable battery, for example. The tag further comprises a controller 200 which may be a processor, a microprocessor or in general an electric circuitry. The tag comprises a short-range communication transceiver 204. Typically, the transceiver operates according to near field communications (NFC) technique. In an embodiment, the tag does not comprise any other wireless communication capabilities other than the short-range communication. In another embodiment, the tag may comprise another short range transceiver such as a Bluetooth™ transceiver.

NFC is a set of short-range wireless technologies, typically requiring a distance of 4 cm or less. NFC may operate at 13.56 MHz on ISO/IEC 18000-3 air interface and at rates ranging from 106 kbit/s to 424 kbit/s. NFC always involves an initiator and a target; the initiator actively generates a radio frequency (RF) field that can power a passive target. This enables NFC targets to take very simple form factors such as tags, stickers, key fobs, or cards that do not require batteries. Above, ISO stands for International Organization for Standardization and IEC for the International Electro technical Commission.

In a passive communication mode the initiator device provides a carrier fields and the target device answers by modulating the existing field. In this mode, the target device may draw its operating power from the initiator-provided electromagnetic field, thus making the target device a transponder. In an embodiment of the invention, the tag 102 is acting as the initiator.

The electronic circuitry of the tag further comprises an antenna 206 connected to the short-range communication transceiver 204 and the controller 200, user interface 208 connected to the controller and a proximity switch 210 also connected to the controller.

Returning to FIG. 1, the door to be opened comprises an electromechanical lock 100. The lock comprises a lock interface 104, a lock antenna 106 and locking mechanism 108. An example of the locking mechanism is a lock bolt. The lock interface may be a doorknob or handle, for example. The lock antenna 106 is connected to an electronic circuitry 110 of the lock. The circuitry comprises a short-range communication device. The device may be an NFC transceiver. In an embodiment, the NFC transceiver of the lock is the target device. The lock does not have a replaceable battery or a connection to a power supply. Thus it is powerless on its own.

Typically, the electronic circuitry 110 may be implemented as one or more integrated circuits, such as application-specific integrated circuits ASIC. Other embodiments are also feasible, such as a circuit built of separate logic components, or memory units and one or more processors with software. A hybrid of these different embodiments is also feasible. The electronic circuitry 110 may be configured to execute computer program instructions for executing computer processes. The lock 100 further comprises an electrically operated actuator 112 which may set the locking mechanism 108 to openable or closed state. Furthermore, the lock may comprise means 114 configured to control the actuator mechanically to return to locked state.

Figure 3:
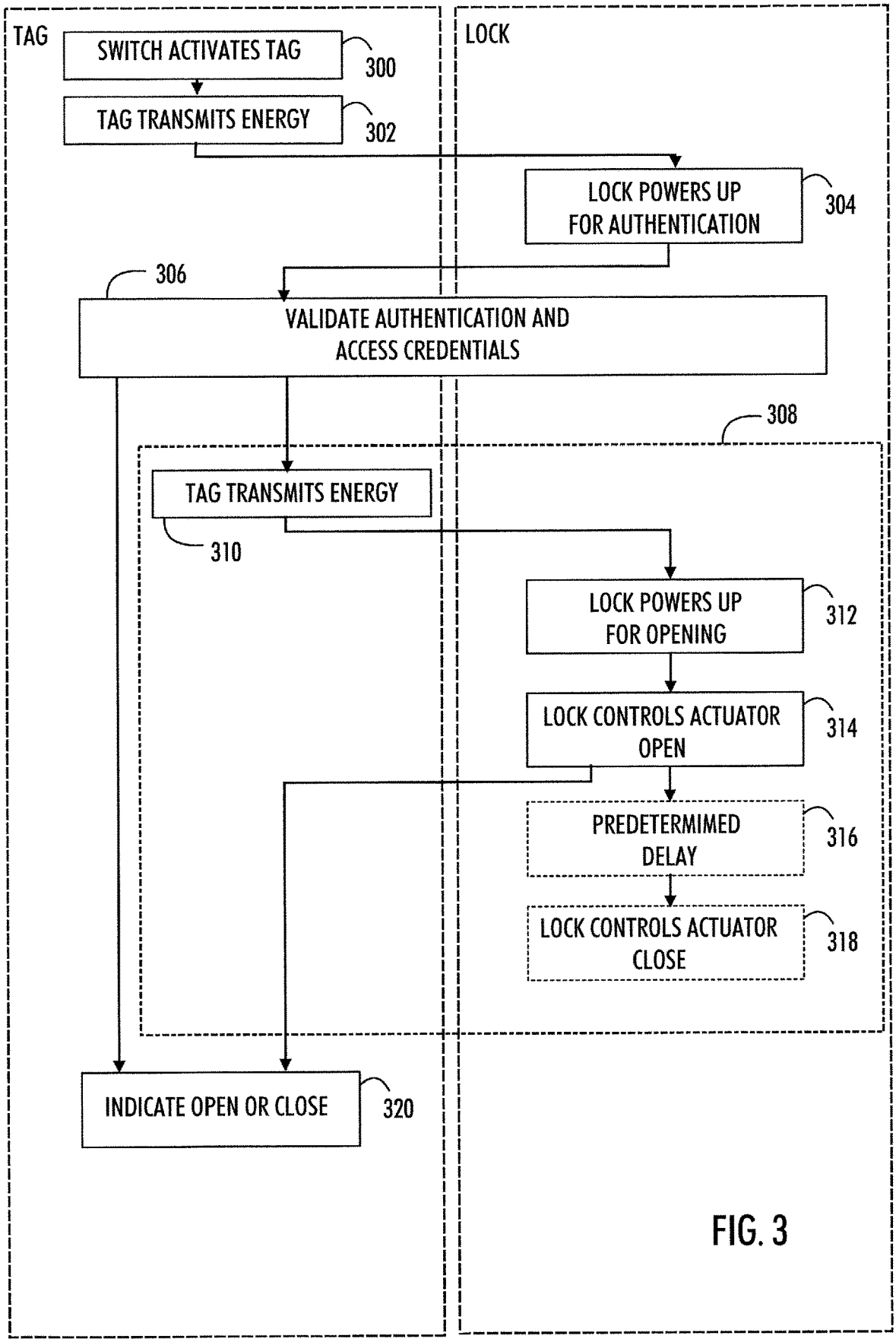
FIGS. 3 and 4 are flowcharts illustrating embodiments.

Let us study an example embodiment with the aid of FIGS. 1, 2 and the flowchart of FIG. 3. The flowchart illustrates communication and actions of the tag 102 and the electromechanical lock 100.

In general, the tag is usually in a low-power state. Most parts of the tag are powered down. A real-time clock may be running and short range communication detection may be possible. Thus, when not used the tag consumes a minimum amount of energy to save the battery.

Let us assume that the user places the tag 102 close to the lock 100 of the door to be opened. In an embodiment, the lock comprises a magnet 116. The magnet may be in the antenna 106 of the lock or it may be located elsewhere, such as in the lock interface 104. In an embodiment, the tag 102 comprises an proximity switch such as a magnetic switch or a hall switch 210. As the tag is brought close to the lock, the switch 210 is activated by the magnet 116 of the lock and the switch activates 300 the tag 102 by activating the controller 200 of the tag.

The controller 200 is configured to control the short-range communication transceiver 204 to transmit energy 302 via an antenna 206. The transceiver 204 obtains energy from the battery 202 of the tag and starts transmitting a signal. The signal is received by the antenna 106 of the lock and the electronic circuitry 110 of the lock is configured to store the received energy for communication and authentication with the tag. The lock powers up 304 using the received energy. The tag is configured to limit the transmission of energy to an amount which is required by the lock just to perform communication and authentication.

Next, the tag and the lock communicate and perform authentication 306. The authentication may be performed using challenge/response pairs, for example. In an embodiment, the tag and the lock first authenticate each other. Then it is checked whether the tag is capable of opening the lock.

After a successful authentication, the tag transmits encrypted access credentials to the lock. The lock is configured to decrypt the access credentials. In an embodiment, the access credentials may comprise, among others, access group of the tag, list of locks tag is authorised to open, time restrictions related to opening locks, list of tags removed from allowed tags (for example due to being lost). Thus, the access data stored in the lock may be updated after authentication. For example, when a tag belonging to a lock system comprising a set of locks and tags is lost, the tag may be listed in a so called black list comprising tags removed from allowed tags. Information on updated black list may be added to each tag and when a tag is used for opening a lock, the updated list may be loaded into the lock.

If the authentication fails, the tag may be configured to indicate 320 the fail on the user interface 208. In an embodiment, the user interface is a led, where failed authentication is indicated with a red light, for example. Transmission of energy from the tag to the lock does not continue.

If the authentication succeeds, setting 308 the lock into an openable state is performed. The controller of the tag controls transmission 310 of energy from the tag to continue and the lock receives 312 power for setting the lock into an openable state. The transmission of power may continue until a required voltage level has been reached or until a given time period has expired.

Next, the electric circuitry 110 controls the actuator 314 to set the lock into an openable state using an electric motor, for example. A signal may be sent to the tag to indicate that the authentication succeeded and the lock was set into an openable state. The tag may be configured to indicate 308 the success on the user interface 208. In an embodiment, the user interface is a led, where succeeded authentication is indicated with a green light. Instead of red and green lights, other visible or audible symbols or indications may be used.

When the lock has been set into an openable state, user may open the lock using the lock interface such as a door knob or lever 104.

Next, after a predetermined time interval 316, the lock may be set into a locked state. The lock may be set into a locked state either mechanically or using electric power.

In an embodiment, the transmission of power from the tag to the lock continues not only for enable the lock to be set into an openable state but also to ensure that the lock may be set back to a locked state In an embodiment, the electric circuit 110 checks 316 whether a predetermined delay has elapsed. If the delay has elapsed, the electric circuit 110 issues a close command 318 to the actuator. In an embodiment, this is realized by the electric circuit giving a command an electric motor move the actuator 112. This closes the lock using the power received from the tag. The above method ensures that in case the lock interface 104 is not operated after setting the lock 100 to openable state, the lock is locked after predefined time.

In an embodiment, the actuator 112 can be set mechanically to locked state. This may be realized by means 114 which are connected to the lock interface such as a door lever and comprise a mechanical connection with the actuator. The means may be a mechanical construction connected to the axis connecting the door lever to the locking mechanism and comprise a semi-fixed connection to the actuator. For example, when the door lever counterclockwise returns to an initial position by a spring, for example, the means force the actuator to set the lock in a locked state.

The tag may further be configured to keep an audit trail of operations related to the tag. For example, all lock openings, authentications and data updates whether successful or not may be stored in the audit trail. The audit trail may be loaded into an external apparatus such as a mobile.

Figure 4:
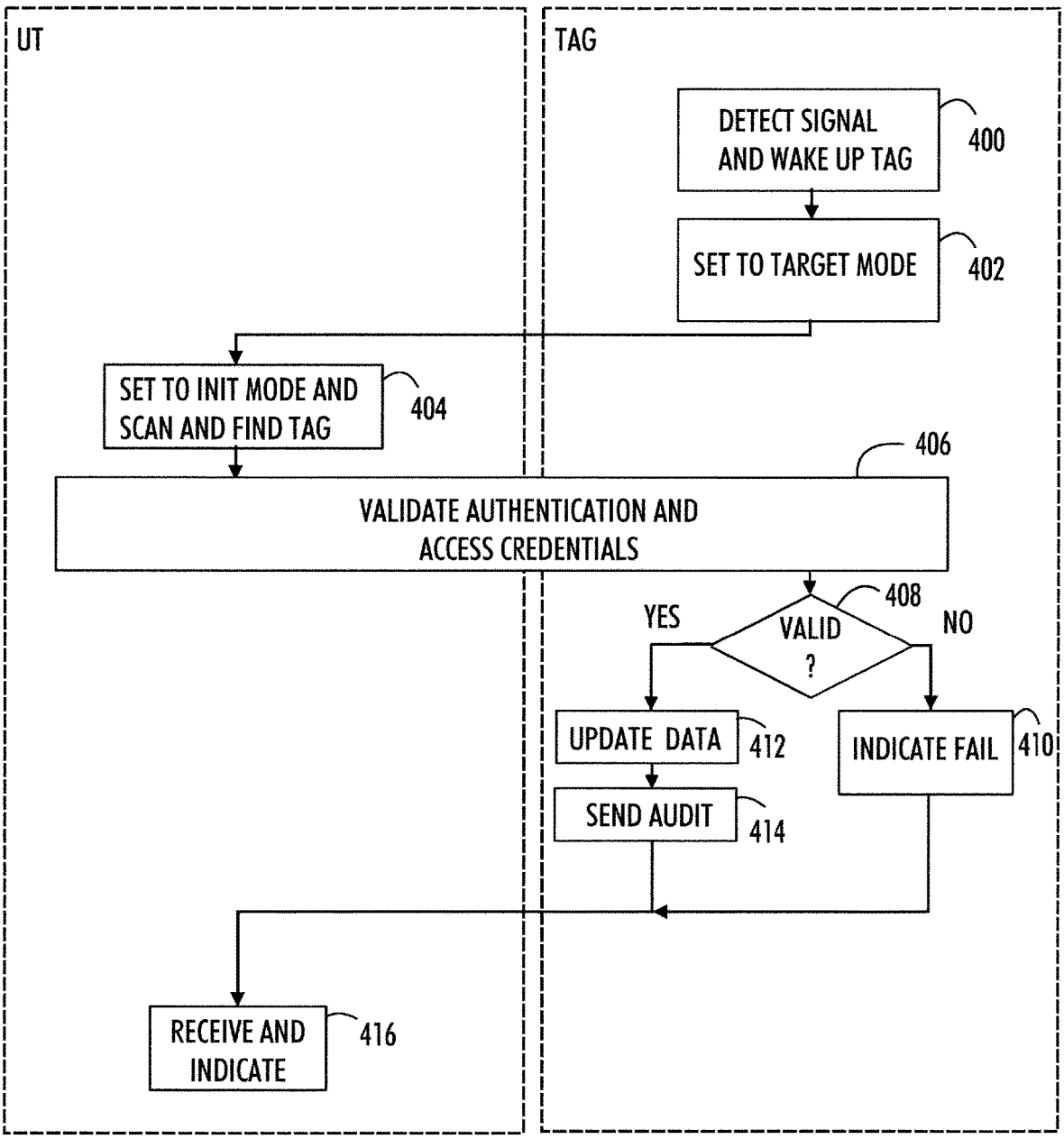

Flowchart of FIG. 4 illustrates an example of how the data stored in the tag 102 may be updated. In an embodiment, the data is updated using an external apparatus capable of near field communication. An example of such an apparatus is a user terminal or mobile phone. However, any other device capable of processing and storing data and capable of near field communication may also be used to update the tag. Such a device may be an NFC device connected or within a computer, for example. The data to be updated may comprise encrypted data packages comprising access credentials and possible time restrictions.

In an embodiment, also other short range communication method such as Bluetooth™ may be used between the external apparatus and the tag for updating data. Below NFC is used as an example.

In an embodiment, the external apparatus may be connected to a server administrating a set of locks, keys and tags forming one or more lock systems.

As mentioned above, in general the tag is in a low-power state. However, the antenna is capable of capturing possible near field communication transmission. The signal is taken 212 to near field communication detector, which may be integrated with the controller 200.

To initiate the update, the user may place the tag and the near field communication enabled external apparatus side by side.

In step 400, the tag detects the short-range communication signal such as an NFC field generated by the external apparatus. The antenna conveys 212 the signal to the short-range communication detector which is configured to wake up the processor and the tag from low-power state.

Upon wake-up, the processor is configured to set 402 the into NFC target mode.

The external apparatus is set into NFC initiator mode whereby it scans 404 nearby NFC tags and finds the tag.

In step 406, the external apparatus and the tag perform authentication. During the authentication process, encrypted access credentials are transmitted to the tag.

If the authentication is not valid 408, the tag may indicate 410 the failed authentication.

If the authentication is valid 408, the tag decrypts the access credentials and updates 412 the data in the tag. In an embodiment, the access credentials may comprise, among others, access group of the tag, list of locks tag is authorised to open, time restrictions related to opening locks, list of tags removed from allowed tags (for example due to being lost). The tag may transmit 414 stored data such as audit records to the external apparatus.

The external apparatus may be configured to indicate 416 whether the authentication and data update was successful and receive audit trail from the tag.

It will be obvious to a person skilled in the art that, as the technology advances, the inventive concept can be implemented in various ways. The invention and its embodiments are not limited to the examples described above but may vary within the scope of the claims.

The invention claimed is:

1. A tag for opening a powerless electromechanical lock, the tag comprising a power source, a near field communication transceiver, an antenna connected to the transceiver, a proximity switch, a detection circuit, and a controller, wherein:

the proximity switch is configured to wake up the controller from a low power mode upon a detection of a predetermined signal;

the controller is configured after the wake up to:

activate the near field communication transceiver in initiator mode and control the transceiver to transmit via the antenna wirelessly first operating power to the lock for communication and authentication;

perform authentication with the lock and, provided that the authentication is successful, control the transceiver to transmit wirelessly second operating power to the lock for the lock to be set into an openable state, and the detection circuit is configured to, when the controller is in a low power mode, detect a near field communication field and wake up the controller from a low power mode on the basis of the detection, the controller is configured after the wake up to:

set the near field communication transceiver into a target mode;

perform authentication utilizing near field communication with an external apparatus, and provided that the authentication is successful, control the transceiver to receive wirelessly access data from the external apparatus, and store the received access data.

2. A tag according to claim 1, further comprising a user interface, the controller being further configured to receive from the lock an indication after the transmission of the second operating power, and control the user interface on the basis of the indication.

3. A tag according to claim 1, wherein the controller is configured to control the transceiver to transmit wirelessly second operating power to the lock for the lock to be set both into an openable state and a locked state.

4. A tag according to claim 3, wherein the access data comprises information on access credentials and times the tag can be used to set the lock into an openable state.

5. A tag according to claim 4, wherein the tag is configured to store access data related to more than one lock.

6. A tag according to claim 1, wherein the proximity switch is a magnetic switch.

7. A tag according to claim 1, wherein the proximity switch is a hall switch.

8. A tag according to claim 1, wherein the controller is further configured to transmit data to the lock during authentication, the data updating access data the lock utilizes in later authentication operations.

9. A tag according to claim 1, wherein the tag is configured to keep an audit trail of operations performed with the tag.

10. A method for operating a tag for opening a powerless electromechanical lock, the tag comprising a controller, the method comprising:

waking the controller up, by a proximity switch, from a low power mode upon a detection of a predetermined signal;

controlling, by the controller, a near far communication transceiver in initiator mode to transmit via an antenna wirelessly first operating power to the lock for communication and authentication;

performing, by the controller, authentication with the lock, provided that the authentication is successful, controlling, by the controller, the transceiver to transmit wirelessly second operating power to the lock for the lock to be set into an openable state, and when the controller is in a low power mode, detecting a near field communication field, and waking up the controller from a low power mode on the basis of the detection, setting, by the controller, the near field communication transceiver into a target mode;

performing, by the controller, authentication utilizing near field communication with an external apparatus, and provided that the authentication is successful, controlling the transceiver to receive wirelessly access data from the external apparatus, and storing by the controller the received access data.

11. A method according to claim 10, further comprising receiving from the lock, by the controller, an indication after the transmission of the second operating power, and controlling a user interface of the tag on the basis of the indication.

12. A method according to claim 10, further comprising controlling the transceiver to transmit wirelessly second operating power to the lock for the lock to be set both into an openable state and a locked state.

13. A method according to claim 12, wherein the access data comprises information on access credentials and times the tag can be used to set the lock into an openable state.

14. A method according to claim 13, wherein the tag is configured to store access data related to more than one lock.

15. A method according to claim 10, wherein the proximity switch is a magnetic switch.

16. A method according to claim 10, wherein the proximity switch is a hall switch.

17. A method according to claim 10, wherein the controller is further configured to transmit data to the lock during authentication, the data updating access data the lock utilizes in later authentication operations.

18. A method according to claim 10, wherein the tag is configured to keep an audit trail of operations performed with the tag.

* * * * *